United States Patent [19]

Hardin

[11] Patent Number: 4,878,257

[45] Date of Patent: Nov. 7, 1989

[54] COUNTER-MOUNTED SPLASH GUARD, AND METHODS OF CONSTRUCTING AND UTILIZING SAME

[76] Inventor: Elizabeth V. Hardin, 18227 Valade, Riverview, Mich. 48192

[21] Appl. No.: 82,302

[22] Filed: Aug. 6, 1987

[51] Int. Cl.[4] ..... E03C 1/181

[52] U.S. Cl. ..... 4/658; 4/520; 4/523; 4/621

[58] Field of Search ..... 4/621, 622, 654, 655, 4/657, 658, 519–523; 248/363

[56] References Cited

U.S. PATENT DOCUMENTS

| | | | |
|---|---|---|---|
| 907,423 | 12/1908 | Tilley . | |
| 1,170,326 | 2/1916 | Posivak . | |
| 1,314,060 | 8/1919 | Hagerstrom . | |
| 1,882,624 | 10/1932 | Jackson | 4/519 |
| 1,983,187 | 12/1934 | Oswell | 312/140.4 |
| 2,131,111 | 7/1938 | Marsh | 4/658 |
| 2,236,339 | 3/1941 | Keith | 4/657 |
| 2,297,639 | 9/1942 | Thauwald | 4/520 |
| 2,539,781 | 1/1951 | Heaney | 311/106 |
| 2,558,817 | 7/1951 | Bryant | 248/363 X |
| 2,803,834 | 8/1957 | McClung | 4/522 |
| 2,988,753 | 6/1961 | Corvelli | 4/621 X |
| 4,385,408 | 5/1983 | Rhodes | 4/519 X |
| 4,411,032 | 10/1983 | Lewy | 4/523 |

OTHER PUBLICATIONS

Colonial Kitchen Magazine, p. 58, Summer (1988).

*Primary Examiner*—Charles E. Phillips

*Attorney, Agent, or Firm*—Irving M. Weiner; Joseph P. Carrier; Robert M. Petrik

[57] ABSTRACT

An apparatus for preventing the overflow and spillage of liquids from a sink or tub. The apparatus is attachable to the front portion of a counter top, and is provided with removable internal absorption means to prevent liquids from passing thereby and onto the user or the floor.

4 Claims, 1 Drawing Sheet

COUNTER-MOUNTED SPLASH GUARD, AND METHODS OF CONSTRUCTING AND UTILIZING SAME

BACKGROUND OF THE INVENTION

1. Field of the Invention

The present invention relates generally to sink counter accessories, and particularly relates to a device for attachment to a sink counter front for keeping the washer dry while washing dishes or other articles and for preventing the spillage of water onto the floor.

2. Description of the Relevant Art

The relevant art is exemplified by Tilley U.S. Pat. No. 907,423 entitled "FOLDING WASHSTAND"; Posivak U.S. Pat. No. 1,170,326 entitled "ADJUSTABLE BOOK RACK AND STAND"; Hagerstom U.S. Pat. No. 1,314,060 entitled "DISAPPEARING EDGE STRIP FOR DRAFTING TABLES AND THE LIKE"; Oswell U.S. Pat. No. 1,983,187 entitled "COUNTER SET-UP RACK"; Heaney U.S. Pat. No. 2,539,781 entitled "TABLE-RAIL SUPPORTING BRACKET"; and Fink U.S. Pat. No. 3,331,226 entitled "LAUNDRY APPARATUS".

The present invention includes features which are not taught or suggested by the relevant art. These features provide a counter mounted splash guard for preventing the spillage of water onto the user and the floor.

SUMMARY OF THE INVENTION

The present invention provides a counter mounted splash guard apparatus comprising an elongate channel-shaped guard body element adapted to span the approximate width of a conventional sink or tub, an absorption means fitted within the guard body, and a means for attaching the guard body element to the end portion of a counter. The guard may be permanently attached or, preferably, may be removably attached to a counter front. The absorption means comprises conventional sponge material which is preferably removably fitted to the interior portion of the guard body by a detachable means such as Velcro (trademark).

An object of the present invention is to provide a counter mounted splash guard apparatus which is inexpensive to construct and is easy to maintain.

Another object of the invention is to provide such an apparatus which is a complete counter guard unit capable of absorbing liquids.

Yet another object of the invention is to provide such an apparatus which mounts easily to a counter front.

A further object of the present invention is to provide a counter mounted splash guard which may be either permanently or removably attached to the front of a counter.

Another object of the present invention is to provide such an apparatus which is fitted with one or more strips of sponge material for absorbing and retaining fluid.

Still another object of the present invention is to provide a means which allows removable attachment of the absorptive sponge material from the splash guard apparatus.

Still a further object of the present invention is to provide such an apparatus which is light weight and is easily stored.

Yet a further object of the present invention is to provide such an apparatus which is comprised of a minimum number of component parts.

And still a further object of the present invention is to provide such an apparatus which is capable of being fitted to a variety of sizes and shapes of counters.

For the accomplishment of these and related objects which shall become apparent as the description proceeds, the present invention resides in the construction, combination and arrangement of parts as shall be hereinafter more fully described, illustrated in the accompanying drawings, and pointed out in the appended claims.

DETAILED DESCRIPTION OF THE PREFERRED EMBODIMENTS

Figure 2:
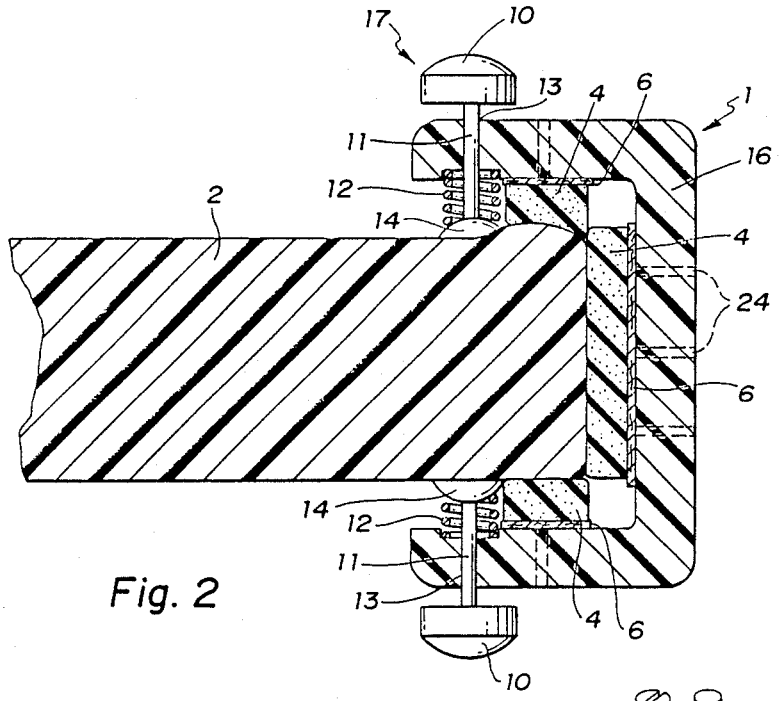
FIG. 2 illustrates a cross section of a splash guard apparatus in accordance with a preferred embodiment of the present invention fitted to a suggested counter, also shown in cross section.
Figure 3:
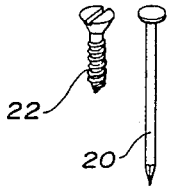
FIG. 3 illustrates a perspective view of conventional fastening means which are used in an alternate embodiment of the present invention for fitting the counter guard apparatus to a counter.
Figure 1:
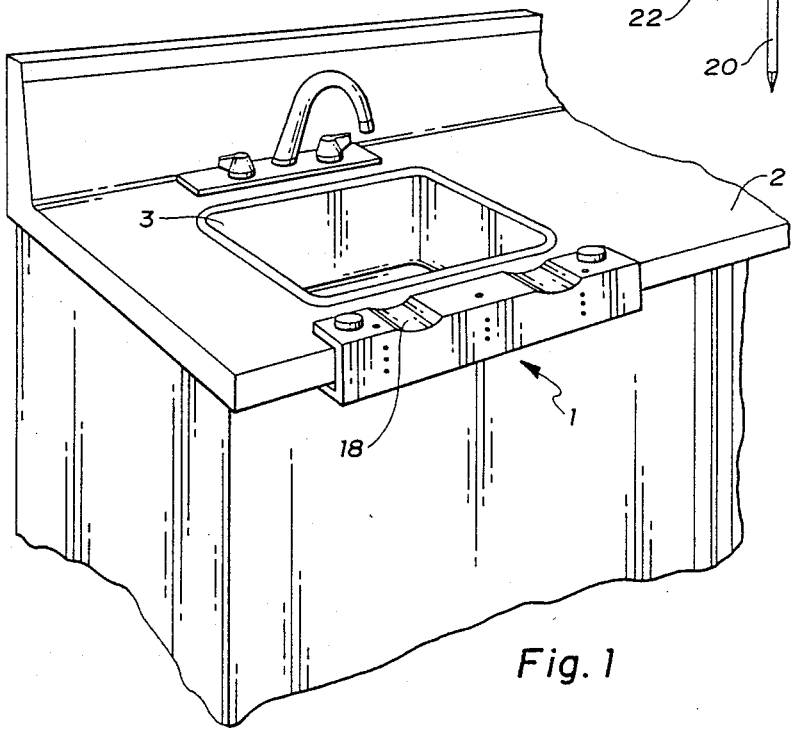
FIG. 1 illustrates a perspective view of a counter mounted splash guard apparatus according to one embodiment of the present invention in place on the front of a counter.

The invention is characterized as relating to means for absorbing fluids which may escape a sink or a tub. Because most sinks or tubs are fitted into counter tops, a splash guard fittable to the front portion of a counter top to absorb liquids splashing or leaking therefrom is highly practical and desirable. FIGS. 1–3 relate to preferred embodiments of a counter guard apparatus suited for this purpose.

FIG. 1 illustrates a preferred embodiment of the present invention, generally indicated by 1, adapted to the front of a counter 2. Counter 2 represents a conventional counter top, although it is envisioned that a variety of styles and shapes of counter tops may be fitted with guard apparatus 1 without modification thereof. Placement of guard apparatus 1 is made, as illustrated, generally at the front of a sink or tub, indicated as 3. Preferably, but not exclusively, the length of guard apparatus 1 is at least as great as, or greater than, the frontal width of sink 3.

Preferably, but not exclusively, guard apparatus 1 is covered with a yieldable, cushioned material for the added comfort of the user. Additionally, and to optionally provide further comfort, arm rests or indentations 18 may be provided.

With reference now to FIG. 2, an embodiment of the present invention and the counter to which it is fitted are shown in cross section.

Generally indicated by 1, the guard apparatus is fitted to the front portion of counter 2. Preferably, but not exclusively, guard apparatus 1 is comprised of a channel-shaped guard body element 16, which may be composed of any number of materials, including wood or a polymeric material.

Fittable to the inside walls of guard body element 16 are one or more absorption means 4. Preferably, but not exclusively, each strip of absorption means 4 is comprised of a porous rubber or cellulosic material capable of absorbing and retaining liquids. Preferably, but not exclusively, three strips of absorption means 4 are provided which substantially span the length of guard body element 16, one strip of absorption means 4 being fitted to each of the three inside walls of element 16.

Preferably, but not exclusively, absorption means 4 are removably attached to the inner walls of guard body element 16 by a removably self-attaching means 6. In conformity with the present embodiment, the preferred means of removable attachment comprises a nylon fabric which can be fastened to itself, such as Velcro (trademark).

According to a first embodiment of the present invention, an attachment means is provided to removably attach guard apparatus 1 to counter 2. Although it is envisioned that a variety of conventional means may be employed for allowing removable attachment of the apparatus to counter 2, preferably, but not exclusively, such removable attachment is accomplished by means of a locking system generally indicated by area 17. Preferably, but not exclusively, locking system 17 is comprised of elongate shaft 11 slidably residing in aperture 13, having fitted at one end pull knob 10 and at its other end suction cup 14. Coaxially provided about elongate shaft 11 is spring 12 which preferably abuts suction cup 14 at its one end and an inside area of guard body element 16 at its other end. Spring 12 functions to firmly press suction cup 14 against counter 2, yet is infirm enough to permit cup 14 to be retracted from counter 2 when pull knob 10 is pulled away from guard element 16.

Optionally provided through guard element 16 are one or more breathing apertures 24. So positioned, drying air is allowed to more efficiently circulate through and pass by guard apparatus 1, thereby providing the efficient drying thereof.

Breathing apertures 24 may serve a dual purpose. In addition to allowing the circulation of air therethrough, according to an alternate embodiment of the present invention, guard apparatus 1 may be permanently mounted to counter 2 by conventional fastening means, illustrated in various forms in FIG. 3 which shows a conventional nail 20 and a convention screw 22. For permanent mounting, which may be preferred, nail 20 or screw 22 are conventionally driven through one or more of breathing apertures 24 and into counter 2.

In use, prior to washing dishes or other articles, the user secures guard apparatus 1 to counter 2. According to a first embodiment, attachment is removably accomplished by withdrawing pull knobs 10 and placing guard apparatus 1 onto counter 2. Pull knobs 10 are then released, and guard apparatus 1 is securely held to counter 2. After use, the user removes guard apparatus 1 from counter 2 by reversing the mounting procedure described above. The user then removes removably mounted absorption means 4 from the interior of guard body element 16, wrings each absorbing strip, then reinstalls means 4 into guard body element 16.

When permanent attachment is desired, attachment is effected by conventionally driving nail 20 or screw 22 through apertures 24 provided in guard body element 16. Drying is permitted via air currents circulating through and passing by guard body element 16.

While the present invention has been illustrated and described in connection with preferred embodiments, it is not to be limited to the particular structures shown, because many variations thereof will be evident to one skilled in the art and are intended to be encompassed in the present invention as set forth in the following claims.

I claim:

1. A counter mounted splash guard apparatus comprising:

an elongate, channel-shaped guard body element having an inside and an outside;

absorption means fittable within said inside of said guard body for absorbing liquids; and means for fastening said apparatus to an end portion of a counter;

said absorption means being removably attachable to said inside of said guard body; and said removable attachment is effected by removably fastenable fabric capable of being fastened to itself.

2. A counter mounted splash guard apparatus comprising:

an elongate, channel-shaped guard body element having an inside and an outside;

absorption means fittable within said inside of said guard body for absorbing liquid; and means for fastening said apparatus to an end portion of a counter;

said means for fastening said guard body element to said end portion of said counter comprises one or more spring-loaded knobs each fitted to a suction cup by means of an elongate shaft slidingly provided through said guard body element.

3. A counter mounted splash guard apparatus comprising:

an elongate, channel-shaped guard body element adapted to span the approximate frontal width of a conventional sink or tub;

said guard body having an inside and an outside;

absorption means fittable to said inside of said guard body for absorbing liquids;

said absorption means adapted to span substantially the length of said guard body; and means for attaching said apparatus to an end portion of a counter;

said absorption means is removably attachable to said inside of said guard body; and said removable attachment is effected by removably fastenable fabric capable of being fastened to itself.

4. A counter mounted splash guard apparatus comprising:

an elongate, channel-shaped guard body element adapted to span the approximate frontal width of a conventional sink or tub;

said guard body having an inside and an outside;

absorption means fittable to said inside of said guard body for absorbing liquids;

said absorption means adapted to span substantially the length of said guard body; and means for attaching said apparatus to an end portion of a counter, wherein sad means for attaching said guard body element to said end portion of said counter comprises one or more spring-loaded knobs each fitted to a suction cup by means of an elongate shaft slidingly provided through said guard body element.

* * * * *